US012546202B2

(12) United States Patent
Gibson et al.

(10) Patent No.: US 12,546,202 B2
(45) Date of Patent: Feb. 10, 2026

(54) SYSTEMS AND METHODS FOR MULTISTAGE FRACTURING

(71) Applicant: The WellBoss Company, Inc., Calgary (CA)

(72) Inventors: Chad Michael Erick Gibson, The Woodlands, TX (US); Derek Slater Payne, Katy, TX (US); Clay Edward Chambers, Richmond, TX (US); Martin Paul Coronado, Fulshear, TX (US)

(73) Assignee: The WellBoss Company, Inc., Calgary (CA)

( * ) Notice: Subject to any disclaimer, the term of this patent is extended or adjusted under 35 U.S.C. 154(b) by 0 days.

(21) Appl. No.: 18/621,763

(22) Filed: Mar. 29, 2024

(65) Prior Publication Data

US 2024/0240550 A1 Jul. 18, 2024

Related U.S. Application Data

(63) Continuation of application No. 17/592,720, filed on Feb. 4, 2022, now Pat. No. 11,965,404.

(60) Provisional application No. 63/146,229, filed on Feb. 5, 2021.

(51) Int. Cl.
*E21B 43/26* (2006.01)
*E21B 33/13* (2006.01)

(52) U.S. Cl.
CPC ..... *E21B 43/261* (2013.01); *E21B 33/13* (2013.01); *E21B 2200/08* (2020.05)

(58) Field of Classification Search
CPC ..... E21B 43/26; E21B 33/134; E21B 33/12; E21B 2200/08; E21B 2200/06; E21B 43/14; E21B 34/142; E21B 34/14
See application file for complete search history.

(56) References Cited

U.S. PATENT DOCUMENTS

| | | | |
|---|---|---|---|
| 9,187,994 | B2 | 11/2015 | Themig |
| 9,428,992 | B2 | 8/2016 | Merron |
| 9,534,471 | B2 | 1/2017 | Etzel |
| 10,156,122 | B2 | 12/2018 | Nguyen et al. |
| 11,098,556 | B2 | 8/2021 | Frazier |
| 11,156,061 | B2 | 10/2021 | Kratochvil |
| 11,454,081 | B2 | 9/2022 | McFarlin et al. |
| 11,913,311 | B2 | 2/2024 | Fitzhugh et al. |
| 2017/0002628 | A1 | 1/2017 | Van Petegem et al. |
| 2020/0115988 | A1 | 4/2020 | Wilcox et al. |
| 2022/0136360 | A1 | 5/2022 | Buckland |

FOREIGN PATENT DOCUMENTS

CA 3010275 A1 * 7/2017 ..... E21B 33/1285

OTHER PUBLICATIONS

English translation of CN 208718615. (Year: 2019).*

* cited by examiner

*Primary Examiner* — Zakiya W Bates

(74) *Attorney, Agent, or Firm* — Kearney, McWilliams & Davis, PLLC; John M. DeBoer

(57) ABSTRACT

A plugging device for multistage fracturing wherein a stopper assembly is installed in the plugging device in manner that allows pressure integrity from above the plugging device, and the stopper assembly is further configured to allow a bore of the plugging device to open with an at least minimal pressure from therebelow in order to remove a stopper from the stopper assembly in order to open a flow path through the plugging device in either direction.

15 Claims, 15 Drawing Sheets

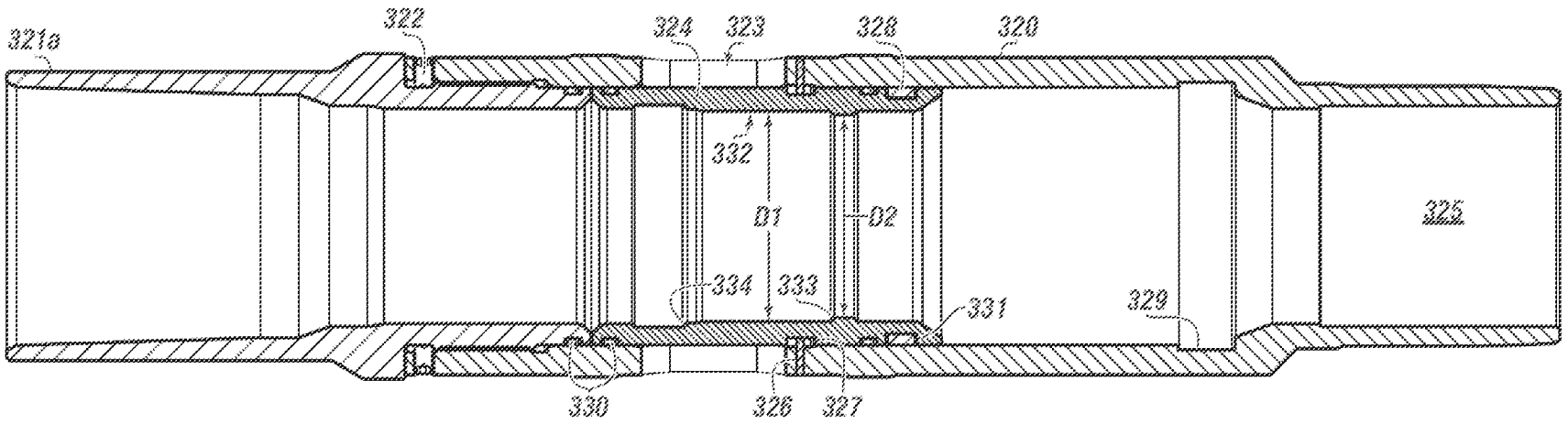
FIGURE 3A
FIGURE 3B
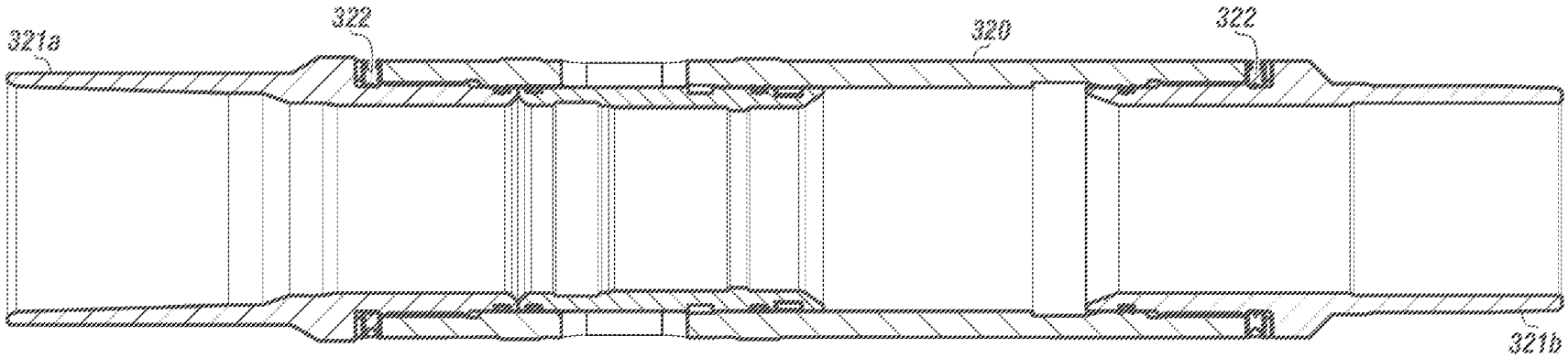

SYSTEMS AND METHODS FOR MULTISTAGE FRACTURING

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool(s) that may be run into a wellbore and useable for wellbore isolation, and methods pertaining to the same. In particular embodiments, the disclosure presents a system and method for stimulating a formation in multiple stages while providing an operator with flexibility in the stages that are to be stimulated or isolated from stimulation. In still other embodiments, a single plugging device may be used to activate one or more frac sleeves. The plugging device may have a removable stopper that facilities flow through the plugging device in either direction.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. One form of a frac operation may be a 'plug and perf' type, such as described or otherwise disclosed in U.S. Pat. No. 8,955,605, incorporated by reference herein in its entirety for all purposes.

In this type of operation, the tubestring does not have any openings through its sidewalls; instead, perforations are created by so-called perforation guns which discharge shaped charges through the tubestring and, if present, adjacent cement. The zone near the perf is then hydraulicly fractured, followed by the setting of a new plug, re-perf, etc. That process is repeated until all zones in the well are fractured.

The plug and perf method is widely practiced, but it has a primary drawback of being time consuming. Other problems include: plug defects (such as slippage, presets, hang ups, and drillout issues), perf erosion, wireline and drillout crew resource required, and the plug run times associated with wireline, especially during single well operations.

Multistage fracturing is another form of frac operation that also enjoys popularity. In this type of frac operation, multi-stage wells require the stimulation and production of one or more zones of a formation. Conventionally, a liner, casing, or other type of tubestring is downhole, in which the tubestring includes one or more downhole frac valves (any may further include, but not be limited to, ported sleeves or collars) at spaced intervals along the wellbore.

Such frac valves typically include a cylindrical housing that may be threaded into and forms a part of the tubestring. The housing defines a flowbore through which fluids may flow. Ports are provided in the housing (e.g., sidewall) that may be opened by actuating a sliding sleeve. Once opened, fluids are able to flow through the ports and fracture the formation in the vicinity of the valve, and vice versa.

The location of the frac valves is commonly set to align with the formation zones to be stimulated or produced. The valves must be manipulated in order to be opened or closed as required. In the case of multistage fracking, multiple frac valves are used in a sequential order to frac sections of the formation, typically starting at a toe end of the wellbore and moving progressively towards a heel end of the wellbore. It is crucial that the frac valves be triggered to open in the desired order and that they do not open earlier than desired.

By way of example, FIG. 1 shows a conventional multistage production system using a plurality of frac valves 102. The frac valves 102 may be incorporated into a tubular 104 disposed in a typical wellbore 106 formed in a subterranean formation 110.

The wellbore 106 may be serviced by a derrick 103 and various other surface equipment (not shown). The wellbore 106 may be provided with a casing string 105, which may be part of tubular 104. The tubular 104 may include or be coupled with the casing string 105 via a hanger 101. It will be noted that part of the wellbore 106, and part of the wellbore may be generally horizontal. The tubular 104 may be cemented in place via cement 107.

A typical frac operation will generally proceed from the lowermost zone in the wellbore (sometimes the 'toe') to the uppermost zone (sometimes the 'heel'). FIG. 1 shows fractures 109 have been established in the vicinity of the frac valves 102 in zones near the toe 111. Additional uphole zones in the wellbore 106 may be fracked in succession until all stages of the frac operation have been completed, and fractures in all desired zones have been established.

In some instances (not viewable here), the tubular 104 is arranged with valves having seats of increasing inside diameter progressing from toe to heel. The valves are manipulated by pumping multiple plug devices, such as balls, plugs or darts, each having sequentially increasing outside diameters, down the tubestring. The first plug, having the smallest outside diameter passes through all frac valves until it seats on the first (or furthermost) valve seat, having the smallest inside diameter.

When a plug lands on a respective seat, fluid pressure uphole of the plug urges the plug downhole, which causes it to induce analogous movement of a sleeve of the valve downhole, which exposes the ports of the frac valve. In this arrangement, each valve must be uniquely built with a specific seat size and must be arranged on the tubestring in a specific order. Additionally, a stock of plug devices of all sizes of diameter must always be maintained to be able to manipulate all of the unique valve seats.

In other cases, opening of the frac valve is achieved by running a bottom hole assembly, also known as an intervention tool, down on a workstring through the tubestring, locating in the frac valves to be manipulated and manipulating the valve by any number of means including use of mechanical force on the intervention tool, or by hydraulic pressure. However, the use of an intervention tool is not always desirable; the workstring on which the intervention tool is run presents a flow restriction within the tubestring and prevents the full-bore fluid flow required within the tubestring to achieve the needed stimulation pressure.

Despite popularity, multistage fracturing with frac valves has its own share of problems. Sleeve design problems include: limited number of stages per well, the need for coiled tubing in the hole during operations, and the need for drilling out seats post operations. Many conventional systems utilize a ball drop process that requires a high amount of precision not always achievable. Modern designs that attempt to solve these issues are overly complex, and require a wide array of varied tools (which corresponds to high manufacture costs).

In other instances, the frac operation may result in saturation or other form of obstruction of the target formation, such that no more sand may be injected thereinto (akin to a 'screen out'). When this occurs, the tubestring is full of sand, and production is prohibited. Removing a ball will not relieve the problem, as the spherical nature of the ball will result in a reseat. If the frac valve could have bidirectional flow established, it would be easier to clear the tubestring of sand. While a dissolvable ball might be of some use, dissolving times are unfavorable.

A need exists for simple but robust system in which multiple frac valves (one or more of which may be identical) may be run downhole, and may be opened in any sequence by a single device.

There is a need for a frac valve system that does not require the use of an intervention tool or of unique frac valves and dedicated balls or plugs. There is a need for a system that may be operable to open one or more frac valves in any order desired, and may provide for repeated opening and closing one or more frac valves within a tubestring for varying purposes. There is a need to provide bidirectional flow through a frac valve in a quick and expedient manner.

The ability to save cost on materials and/or operational time (and those saving operational costs) leads to considerable competition in the marketplace. Achieving any ability to save time, or ultimately cost, leads to an immediate competitive advantage.

Accordingly, there are needs in the art for novel systems and methods for isolating wellbores in a fast, viable, and economical fashion.

SUMMARY

Embodiments of the disclosure pertain to a downhole system for stimulating one or more stages of a downhole wellbore. The system may include one or more frac valves arranged on or with a tubular; any of such frac valves presenting an identical or comparable inside profile to another, and any of which may be openable for providing fluid communication between internal and external of the tubular. There may be an at least one dart or plugging device deployable into the tubular, and being adjustable to pass through one or more frac valves without opening one or more frac valves, and yet may be able to engage and open one or more other frac valves.

Other embodiments of the disclosure pertain to a system for stimulating a subterranean formation that may include a wellbore formed within the subterranean formation; and a tubular disposed within the wellbore.

Embodiments of the disclosure pertain to a downhole system for multistage fracturing a subterranean formation that may include one or more of: a first cluster of valves; a second cluster of valves downhole of the first cluster; and a third cluster of valves downhole from the second cluster.

Embodiments herein may pertain to a plugging device having a plug body. The plug body may have a distal end, a proximate end, and an outer surface. There may be a plurality of grooves disposed on the outer surface. The plugging device may have an index sleeve movingly disposed on the outer surface. The index sleeve may be configured to engage one or more of the plurality of grooves.

In assembly, the index sleeve may be set in an initial position corresponding to the desired target frac valve. The index sleeve may be in the initial position prior to entering the first cluster of valves. During engagement with a frac valve of the first cluster, the index sleeve may be incremented one groove of the plurality of grooves. The index sleeve may be moved to a first armed position by one of the second cluster of valves. The plugging device may not open any valves of the first and second cluster of valves, but opens every valve of the third cluster of valves.

The plugging device may engage, but need not open, any of the frac valves of the first and second cluster of valves. The plugging device may engage and open the frac valve of the third cluster of valves.

The body of plugging device may be multi-component, and include any of: a lower sleeve engaged with the distal end; an upper sleeve engaged with the proximate end; and/or a removable plug or stopper sealingly disposed therein.

Other embodiments pertain to a plugging device having a plug body. The plug body may have a distal end, a proximate end, and an outer surface. There may be a plurality of grooves disposed on the outer surface. The plugging device may have an index sleeve movingly disposed on the outer surface. The index sleeve may be configured to engage any of the plurality of grooves.

Still other embodiments pertain to a frac valve—plugging device assembly. The assembly may include the plugging device engaged with the frac valve.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 3A shows a longitudinal side cross-sectional view of a solid sleeve frac valve, according to embodiments of the disclosure;

FIG. 3B shows a longitudinal side cross-sectional view of a solid sleeve frac valve having a lower end fitting, according to embodiments of the disclosure;

DETAILED DESCRIPTION

Figure 1:
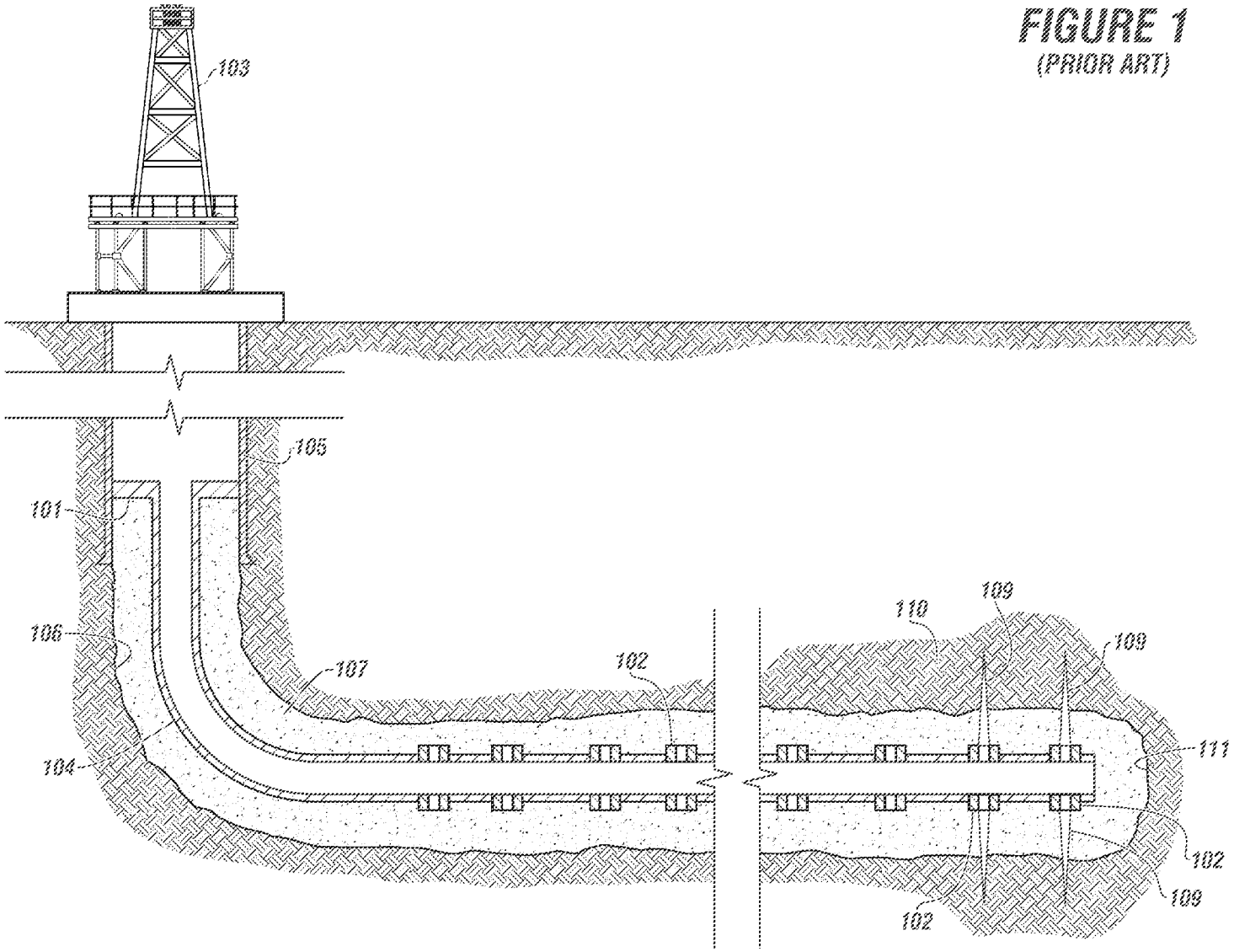
FIGURE 1 (PRIOR ART)
FIG. 1 shows a side view of a process diagram of a conventional multistage fracture system.

Herein disclosed are novel apparatuses, assemblies, systems, and methods that pertain to and are usable for wellbore operations, and aspects (including components) related thereto, the details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure, unless expressly indicated otherwise.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "tubestring" or the like as used herein may refer to a tubular (or other shape) that may be run into a wellbore. The tubestring may be casing, a liner, production tubing, combinations, and so forth. A tubestring may be multiple pipes (and the like) coupled together.

The term "workstring" as used herein may refer to a tubular (or other shape) that is operable to provide some kind of action, such as drilling, running a tool, or any other kind of downhole action, and combinations thereof.

The term "frac operation" as used herein may refer to fractionation of a downhole well that has already been drilled. 'Frac operation' can also be referred to and interchangeable with the terms fractionation, hydrofracturing, hydrofracking, fracking, fracing, frack, frac, etc. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "machined" can refer to a computer numerical control (CNC) process whereby a robot or machinist runs computer-operated equipment to create machine parts, tools and the like.

Figure 2A:
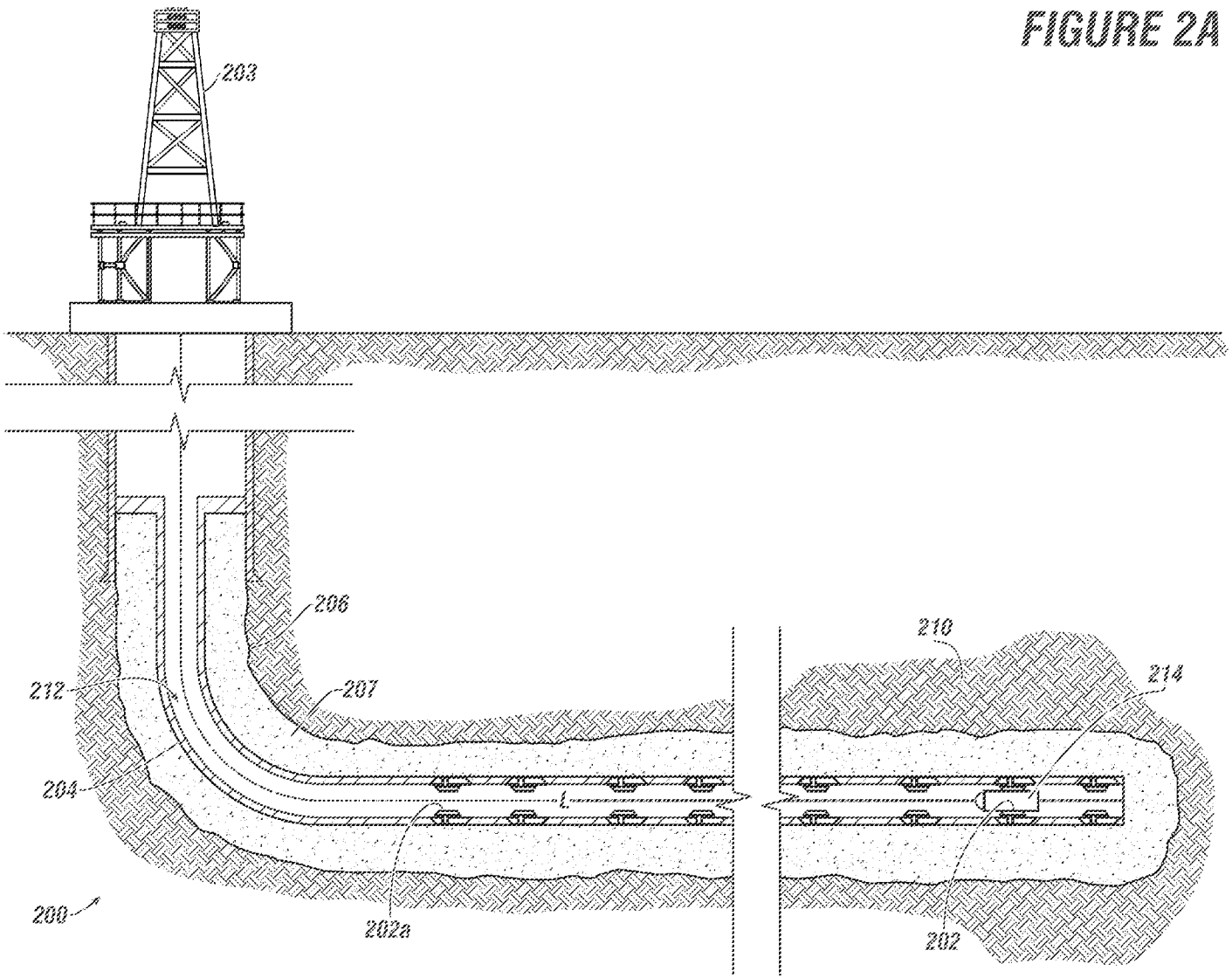
FIG. 2A shows a side view of a multistage fracture system with a cemented tubular having one or more valve clusters according to embodiments of the disclosure.
Figure 2B:
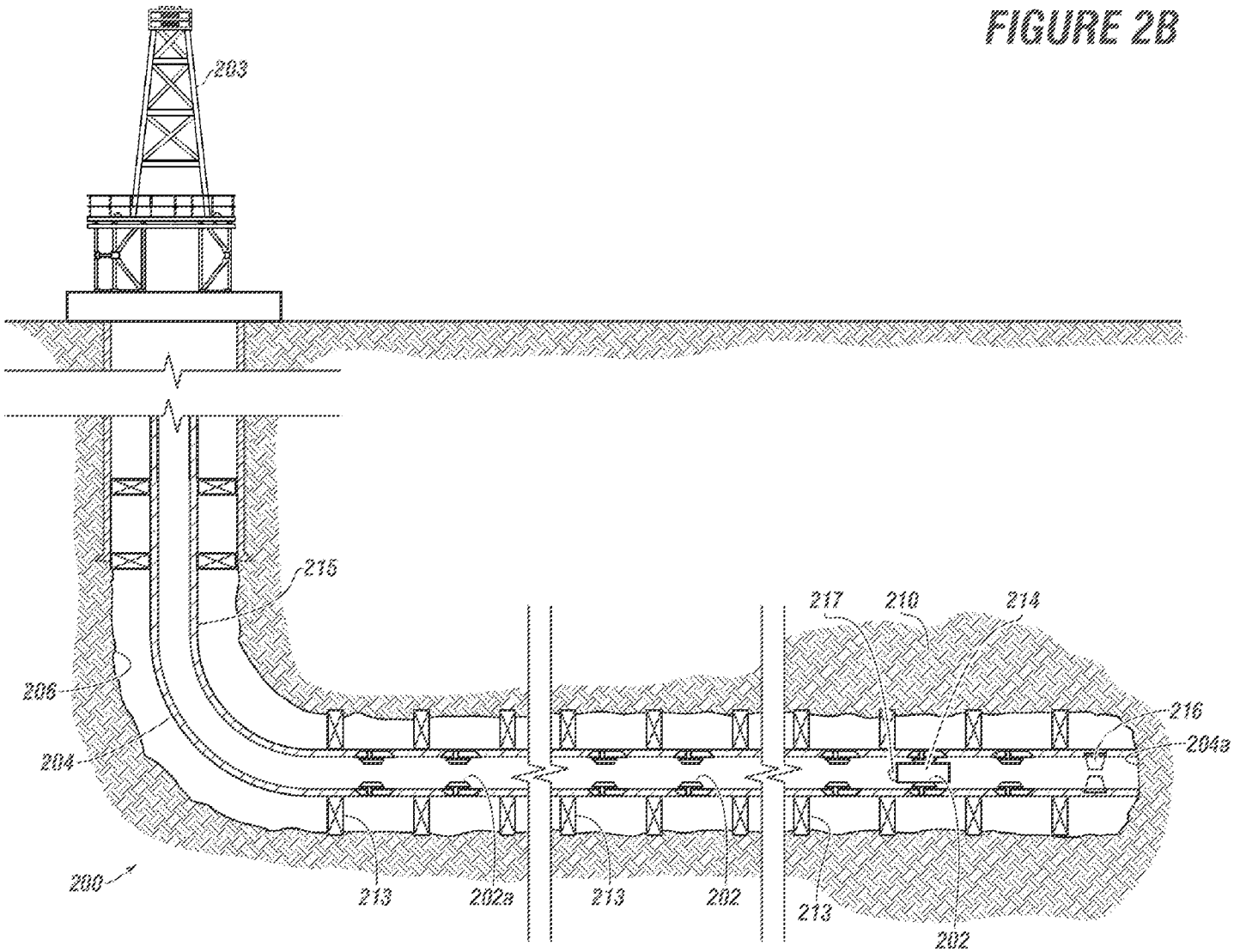
FIG. 2B shows a side view of a multistage fracture system with a packer-supported tubular having one or more valve clusters according to embodiments of the disclosure.

Referring now to FIGS. 2A and 2B together, a side process view of multistage completion system having a cemented tubular, and a multistage completion system having a packer supported tubular, each having a plurality of frac valves, in accordance with embodiments disclosed herein, are shown.

FIGS. 2A and 2B may be contemplated as system 200 being generally similar, with the exception that FIG. 2A illustrates use of cement 207 for the support of a tubular 204, whereas FIG. 2B illustrates use of one or more packers 213. As such, reference may be made to FIGS. 2A and 2B interchangeably in a general sense, unless described or referenced otherwise. That said, embodiments herein are not meant to be limited, and may include the scenario where the wellbore 206 may be both cemented and having packers 213. The packers 213 may be open hole packers.

The wellbore 206 may be an open hole, a cased hole, or a hybrid thereof, with a portion cased and a portion open. The wellbore 206 may be vertical, horizontal, deviated or of any orientation. Embodiments herein may pertain to offshore or onshore operations. The wellbore 206 may be serviced by a derrick 203 and various other surface equipment (pumps, production string, drill string, etc.—not shown).

Components of system 200 may be operable separately or together to provide fluid communication between an inside 212 of the tubular 204 and outside thereof, such as to an annulus 215 or to a surrounding surface 210. The surrounding surface 210 may be (at least a portion of) a subterranean formation.

One or more frac valves 202 may be installed at any point along a length L of the tubular 204. Frac valves 202 may be installed onto or otherwise with the tubular 204, and along the length L at strategic of predetermined points. As the tubular 204 is disposed within the wellbore 206, sections of the tubular 204 may be coupled together, such as when stands of pipe have box and pin ends that are engaged. Valves 202 may be installed between joints of the tubular 204. A lower toe valve 216 may be placed near the lower, or toe end 204*a* of the tubular 204.

A plugging device 214 may be used to shift a sleeve of the frac valve 202 from a first position to a second position. The first position may have ports of the valve closed by the sleeve, and a second position may have ports of the valve opened as the sleeve is shifted. A ball 217 may be used with or be part of the plugging device 214. In embodiments the plugging device 214 may be a dart configured with a ball seat for the ball 217 to seat thereon.

Embodiments herein may entail use of three main components. The aforementioned plugging device 214 and frac valve 202. Alas, various types and configurations of the plugging device 214 and frac valve 202 may be utilized. For example, there may be a first configuration of a frac valve 202 having a solid sleeve. There may be a second configuration of a frac valve 202*a* having a flex sleeve (or collet sleeve). To provide the reader with ease in distinguishing, the first configuration may simply be referred to as frac valve, whereas the second configuration may be referred to as a 'flex valve' (or 'flex frac valve', 'flex sleeve valve, and the like).

The plugging device 214 may be configured to engage either type or both of the frac valve 202 and the flex valve 202*a*. A plurality of valves 202, 202*a* may be referred to as a 'cluster' of valves (or 'valve cluster'). The plugging device 214 may be configured to engage and open a frac valve 202, and also engage and open a flex valve 202*a*. A valve cluster may include at least one frac valve and one flex valve. There may be a plurality of valve clusters. The number of clusters may coincide to the number of stages for completion. For example, if desired to fracture one stage, one cluster of valves may be utilized.

In embodiments, there may be a first frac valve fluster having a first frac valve and first flex valve, and a second valve cluster having a second frac valve and a second flex valve. The plugging device may be configured to engage, but not open the first frac valve, pass through the first flex valve, and engage and open the second frac valve. Other valves 202, 202*a* may be therebetween.

The plurality of valves 202, 202*a* may be installed on, and/or as part of, the tubular 204, and spaced apart as desired or otherwise mentioned herein. The plugging device 214 may be deployed into the tubular 204, and pumped down therein towards the valves 202, 202*a*. Although one or more plugging devices 214 may be utilized, it is within the scope of the disclosure that embodiments herein need only utilize a single plugging device 214 to open multiple valves. The number of plugging devices 214 desired or used may relate to the number of stages of the formation 210 to be stimulated. For example, a first plugging device may be used to open all the valves 202, 202*a* of a first or lower cluster, while a second plugging device may be used to open all the valves 202, 202*a* of a second or upper cluster.

The valves of any cluster need not be identical. With that said, valves 202, 202*a* may have identical (within high tolerance) diameter seat sizes. The frac valves 202 do not need to be installed in any particular order. However, it is within the scope of the disclosure that two or more valves 202, 202*a* may have similar or identical: (within reasonable machine tolerance) end connections (fittings), outside diameter (O.D.), and inside profile. The frac valve 202 may have a valve sleeve (or seat) of the same profile as any other frac valve 202. The sleeve may be shiftable sleeve to expose ports in order to facilitate or allow for fluid communication between an inside of the valve 202 (or tubular 204) and formation 210 surrounding it.

The opening pressure required to shift the sleeve may be adjustable via adjustment or configuration of one or more retainer members. The retainer member may be configured to hold the sleeve in an initial or first closed position. In aspects, any valve 202, 202*a* may be configured with the same opening pressure or force requirement to shift a respective sleeve.

Referring now to FIGS. 3A and 3B together, a longitudinal side cross-sectional view a frac valve and a longitudinal side cross-sectional view a frac valve having a lower end fitting, in accordance with embodiments disclosed herein, are shown.

The frac valve 302 may have a main valve body 320. The frac valve 302 may include one or more end fittings 321*a* and 321*b* (such as shown on 3B), which may be on either or each end of the main body 320. As such, the end fittings 321*a*, 321*b* may be integral with the main body 320, or be coupled therewith, such as threadingly, via the use of one or more respective securing members 322 (e.g., pins, set screws, or the like), or combinations thereof. The use of separate end fittings 321*a*, 321*b* may allow for ease of manufacture of the main body 320, and at the same time allow for the frac valve 302 to be configured for coupling with varied joints. The end fittings 321*a*, 321*b* may be configured for coupling respective ends (e.g., one for box end, other for pin end, etc.) of the tubular (204) joints.

The main body 320 may have an inner bore 325, which may be at least partially open through an entire body length of the valve 302. There may be a valve sleeve (or seat) 324 disposed therein. The valve sleeve 324 may be shiftable. The valve sleeve 324 may be shiftable from a first position to a second position. The first position of the sleeve 324 may be where the ports 323 are closed (e.g., blocked) by the sleeve 324. The second position of the sleeve 324 may be any position thereof whereby the sleeve 324 no longer blocks, at least partially, the ports 323. The second position may include or be related to the breakage at least one retainer member 326. The second position of the sleeve 324 may be a fully open position, which may coincide with the ports 323 being completely unblocked. The second position may include a bias member 328 expanded into a receptacle 329.

The first position may correspond to a lack of communication between the bore 325 and the external side of the valve 302. The second position may correspond to the ability to have fluid communication between the bore 325 and the external side of the valve 302.

The valve sleeve 324 may be held temporarily in place in the first position via one or more retainer members 326. The main body 320 may have a retainer member receptable 327 for the respective member 326 to engage therewith. The retainer member 326 may be a shear screw, pin, etc. As such, the amount of force needed to move the valve sleeve 324 may be predetermined. Once the member(s) 326 breaks, the valve sleeve 324 may freely move. The valve sleeve 324 may also be sealingly engaged with the main body 320 via one or more seals, o-rings, etc. 330.

The valve sleeve 324 may sealingly and slidingly move downward until a sleeve groove 331 may be laterally proximate a main body receptacle 329. The sleeve groove 331 may be circumferential around the outside surface of the sleeve 324. In a comparable manner, the main body receptacle 329 may be circumferential around the inside surface of the main body 320. A biased member, such as a snap ring, 328 may be disposed within the sleeve groove 331. As one of skill would appreciate, as the groove 331 and the receptacle 329 align, the bias member 328 may expand outward, which may then provide an added shoulder or stop for the sleeve 324. The expansion of the bias member 328 into the receptacle 329 may help keep the valve sleeve 324 in place without any further sliding upward or downward.

The sleeve 324 may have an inner sleeve surface 332, which may be defined by a continuous sleeve inner diameter D1. The inner sleeve surface 332 may have an annular sleeve shoulder (or rib, protrusion, catch, seat, etc.) 333, which may be defined with an inner(most) shoulder having a diameter D2. In embodiments, D1 may be greater than D2. The sleeve shoulder 333 may be configured for part of a plugging device (e.g., 214) to engage therewith. In the event the sleeve 324 is shifted, the plugging device may be configured to disengage with the shoulder 333.

An upper end of the inner sleeve surface 332 may form a sleeve seal shoulder 334. The plugging device may also be configured to engage the sleeve seal shoulder 334.

Figure 4:
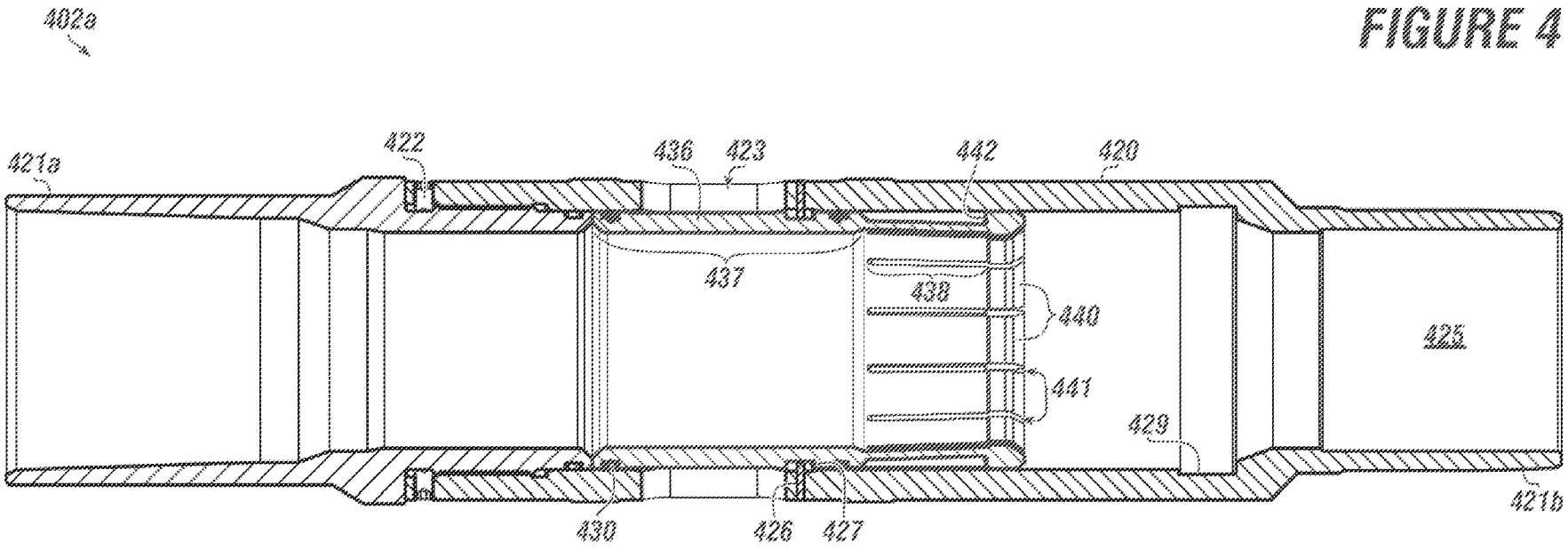
FIG. 4 shows a longitudinal side cross-sectional view of a flex sleeve frac valve, according to embodiments of the disclosure.

Referring now to FIG. 4, a longitudinal side cross-sectional view of a flex valve, in accordance with embodiments disclosed herein, are shown.

By way of comparing FIG. 3 and FIG. 4, one of ordinary skill would appreciate the flex valve 402*a* may be generally similar to the frac valve 302, and in some respect may even be identical. This may useful to help offset problems or expense attributable to machining many varied parts, versus just a few. Still, there may be differences, such as, for example, the presence of a flex sleeve 436. Other differences are within the scope of the disclosure.

The flex valve 402*a* may be run, positioned, and opened as described herein and in other embodiments (such as in system 200, and so forth), and as otherwise understood to one of skill in the art. The flex valve 402*a* may be comparable or identical in aspects, function, operation, components, etc. as that of other valve embodiments disclosed herein. Similarities may not be discussed for the sake of brevity. The flex valve 402*a* may be part of a valve-plugging device assembly.

For the sake of ease to the reader, components of the flex valve 402*a* may be described in a manner comparable to that of the frac valve 302. As such, the flex valve 402*a* may have a main flex valve body 420. The flex valve 402 may include one or more end fittings 421*a* (or comparable to 321*b* on FIG. 3B), which may be on either or each end of the main flex body 420*a*. As such, the end fittings may be integral with the main body 420, or be coupled therewith, such as threadingly, or via the use of one or more respective securing members 422 (e.g., pins, set screws, or the like). The end fittings 421*a*, etc. may be configured for coupling respective ends (e.g., one for box end, other for pin end, etc.) of the tubular (204) joints.

The main body 420 may have an inner flex bore 425, which may be at least partially open through an entire body length of the valve 402*a*. There may be a flex valve sleeve (or seat) 424 disposed therein. The flex valve sleeve 424 may have a rigid portion 437 and a flex portion 438, the flex portion 438 essentially a plurality of fingers 440 (with respective slots 441 therebetween) that may be flexible. As shown in FIG. 4, in an assembled (run-in, first, unactivated, etc.) configuration, the fingers 440 may be in a flexed inward position.

The flex valve sleeve 424 may be shiftable. The valve sleeve 424 may be shiftable from a first position shown in FIG. 4 to a second position (see FIG. 6T). The first position of the sleeve 424 may be where the flex ports 423 are closed (e.g., blocked) by the sleeve 424.

The second position of the sleeve 424 may be any position thereof whereby the sleeve 424 no longer blocks, at least partially, the ports 423. The second position of the sleeve 424 may be a fully open position, which may coincide with the ports 423 being completely unblocked. The second position may include ends 442 of fingers 440 flexed radially outward into a flex body receptacle 429. The flex body receptacle 429 may be an inner annular grove within the body 420.

The first position may correspond to a lack of communication between the bore 425 and the external side of the flex valve 402*a*. The second position may correspond to the ability to have fluid communication between the bore 425 and the external side of the flex valve 402*a*.

The flex valve sleeve 424 may be held temporarily in place in the first position via one or more retainer members 426. The main body 420 may have a retainer member receptable 427 for the respective member 426 to engage therewith. The retainer member 426 may be a shear screw, pin, etc. As such, the amount of force needed to move the flex valve sleeve 424 may be predetermined. Once the member(s) 426 breaks, the flex valve sleeve 424 may freely move. The flex valve sleeve 424 may also be sealingly engaged with the main body 420 via one or more seals, o-rings, etc. 430.

As one of skill would appreciate, as end(s) 442 of respective fingers 440 and the receptacle 429 align, the ends 442 may expand outward. The expansion of the ends 442 into the receptacle 429 may help keep the flex valve sleeve 424 in place without any further sliding upward or downward (and thus the valve 402*a* may be opened, and kept open).

The sleeve 424 may have an inner sleeve surface, which may be defined by a continuous sleeve inner diameter. The inner sleeve surface may be configured for part of a plugging device (e.g., 214) to engage therewith. In embodiments, an inner edge of finger ends 442 may be configured for part of the plugging device to engage therewith. In the event the sleeve 424 is shifted, the plugging device may be configured to disengage therefrom.

Figure 5A:
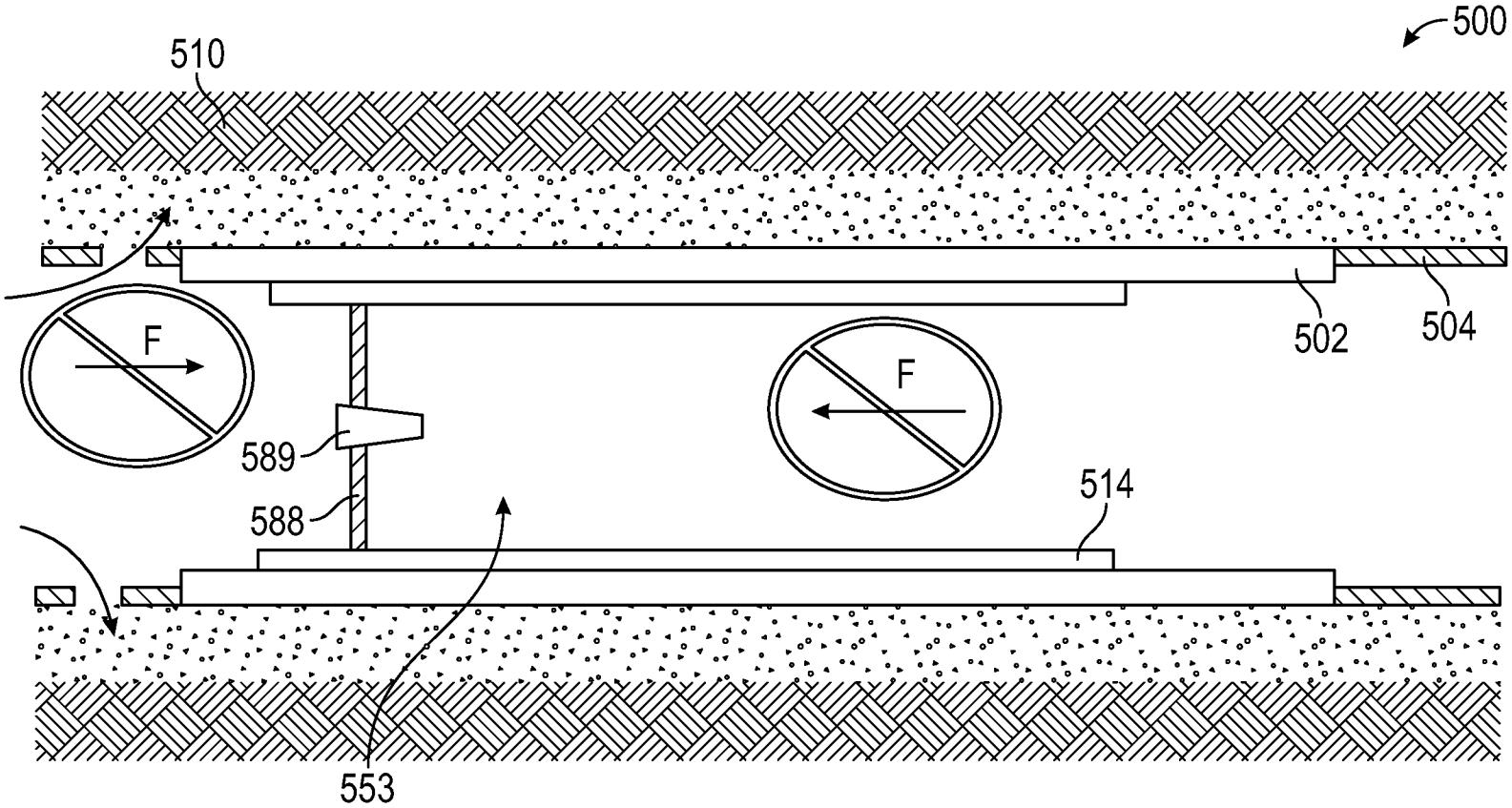
FIG. 5A shows a partial longitudinal side view of a plugging device configured with a baffle, according to embodiments of the disclosure.
Figure 5B:
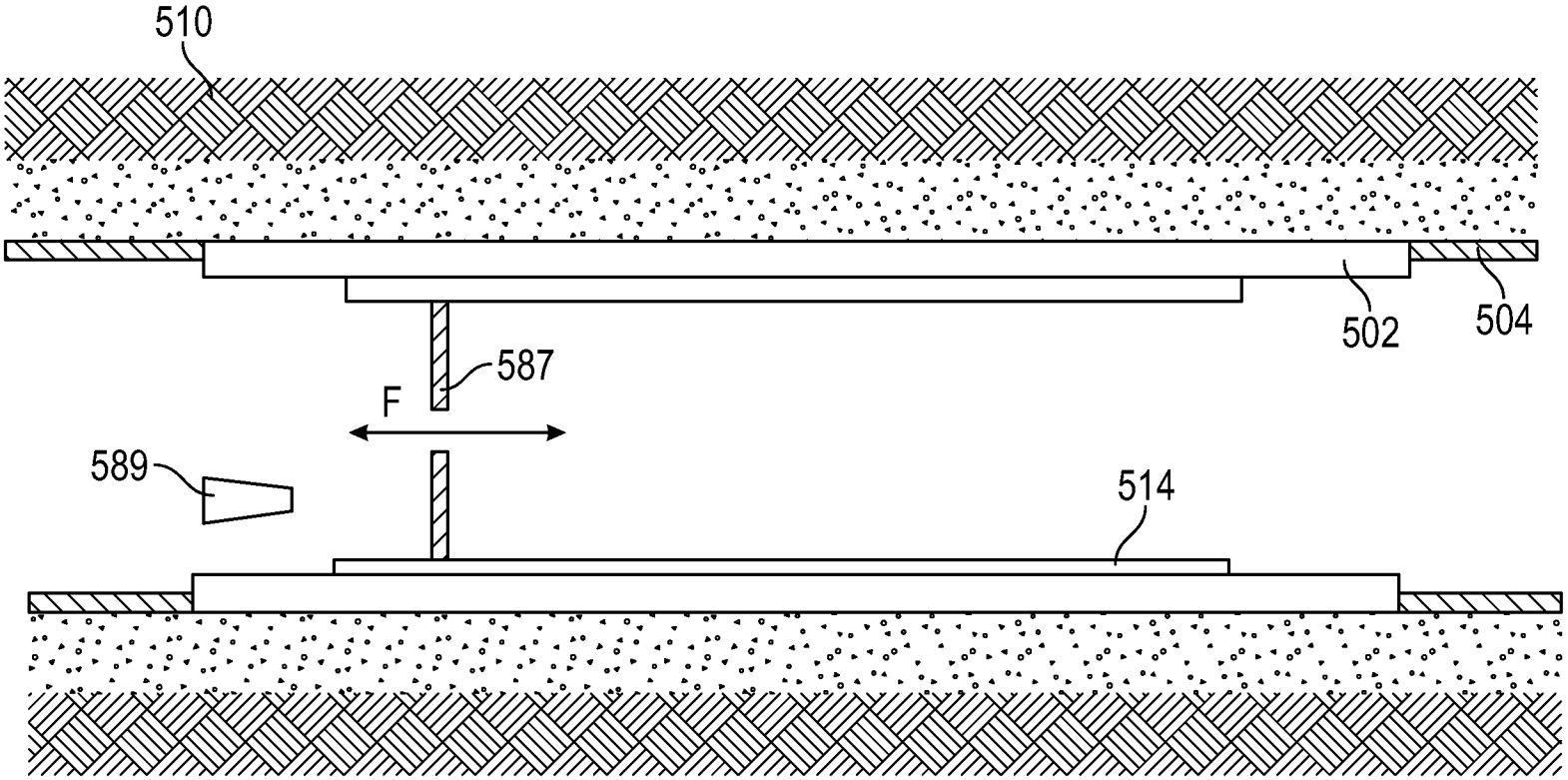
FIG. 5B shows a partial longitudinal side view of the plugging device of FIG. 5A with a stopper removed from the baffle, according to embodiments of the disclosure.

Referring now to FIGS. 5A and 5B, a partial longitudinal side view of a plugging device configured with a baffle, and a partial longitudinal side view of the device of FIG. 5A with a stopper removed from the baffle, respectively, in accordance with embodiments disclosed herein, are shown.

FIGS. 5A and 5B are a simplified representation of a downhole system having a tubular (tubestring, casing string, etc.) 504 configured for coupling with a valve 502. The tubular 504 may be disposed in a wellbore (e.g., 206). The downhole system 500 may include a plugging device 514 configured to engage the valve 502, the operation and function of which may be as indicated for, or comparable to, other embodiments, systems, etc. disclosed herein. As such, the valve 502 may be disposed within the tubular 504. The tubular 504 may be disposed in a wellbore formed in a subterranean formation 510.

The plugging device 514 may be engaged with the valve 502 as would be apparent from embodiments described herein. In some instances of multi-zone fracturing operation, there is a possibility the zone being fractured will "screen-out" during the fracturing operation, and not accept any additional proppant even with high applied pressure. In this instance, the tubular 504 may be full of proppant, sand, etc. which must be removed to continue further operations. Reverse flow from the formation 510 may be required to flow back the proppant, but this takes time to complete.

A quicker method would be to selectively open the plugging device 514 in the frac valve 502 in order to allow or otherwise facilitate the proppant in the tubular 504 to be displaced into the previously fractured zone below the plugging device 514. This method provides a time-efficient means to clean the section of tubular 504 above the device 514 of proppant or other comparable debris.

Embodiments of the disclosure provide for the wherewithal of the system 500 to open a bore 553 through the plugging device 514 to allow fluid and proppant to be displaced through the device. For example, the device 514 may be configured with a battle 588 (e.g., oriented laterally) with a passage 587 ordinarily blocked or obstructed by a stopper 589. The stopper 589 may be asymmetrical, non-spherical, etc. or some other shape suitable to prevent or substantially mitigate any reasonable likelihood of re-seating into the baffle 588.

As shown in FIG. 5A, the fracturing operation does not encounter a sand- or screen-out, the stopper 589 blocks flow F through the passage 587, and the plugging device 514 functions normally and allows proppant to be pumped into the intended stage above or prior to the device 514.

Previously, during a screen out the proppant, sand, etc. in the tubular 504 would have to be reverse circulated out of the wellbore 506 with flow from the formation 510. The embodiment of FIGS. 5A-5B may be different from, for example, a typical ball-seat configuration. As shown here, the device 514 may have a seal from above it, which allows the device 514 to be pumped in the wellbore 506, and landed on its intended seat of the applicable frac valve 502 (so that fracturing operations may be completed).

However, in the event pressure is greater from the formation or zone below the device 514, the stopper 589 may be pushed or otherwise move out of engagement with the baffle 588, and the bore 553 then opens through the device 514.

FIG. 5B illustrates once the stopper 589 is removed, the remaining proppant or other debris in the tubular 504 may be displaced into the zone previously fractured to allow clearing of the proppant (such as during a screen-out occurrence).

Embodiments of a baffle and stopper configuration are not meant to be limited, and may take any number of forms or configurations. In a similar sense, the material choice of the baffle and stopper is not meant to be limited, and any material suitable for wellbore conditions may be used. In embodiments, one or both of the baffle and the stopper may be made from dissolvable material and installed in the body of the plugging device. This may be useful to provide a full bore through the device 514 when the well is put on production, thus does not create a further restriction in the well.

There are any number of ways to accomplish the ability to provide bilateral flow through the device 514, and embodiments herein are not meant to be limited to the examples provided in the figures.

Figure 6A:
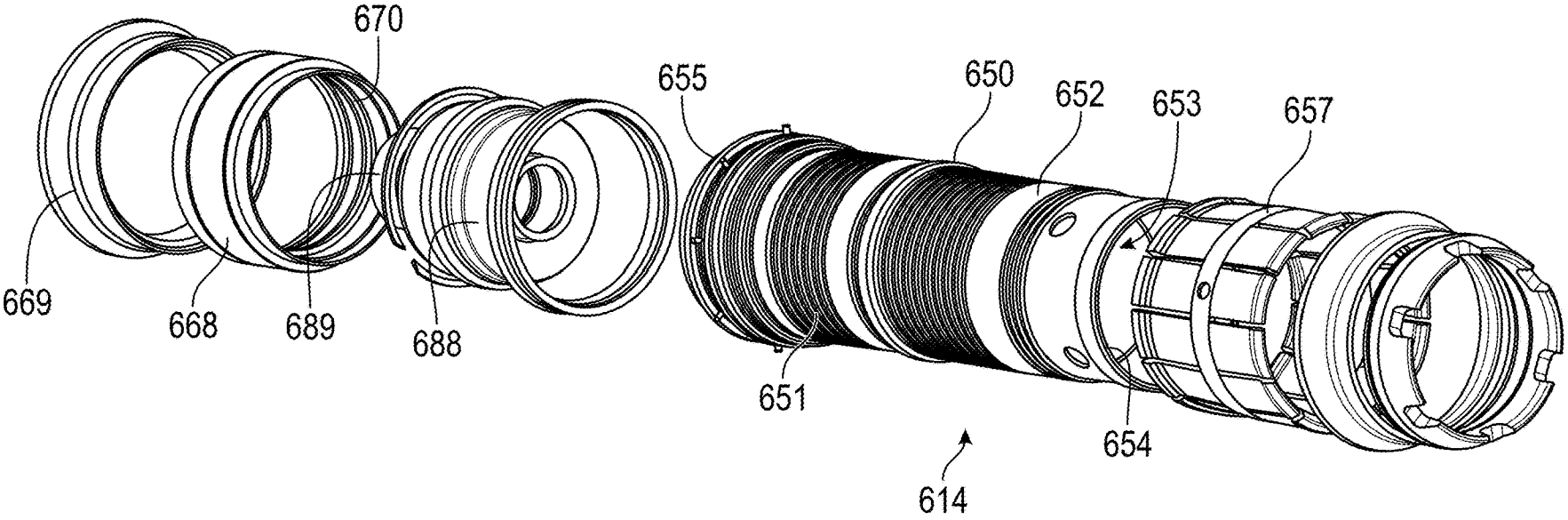
FIG. 6A shows an isometric component breakout view of a plugging device with a stopper assembly, according to embodiments of the disclosure.
Figure 6B:
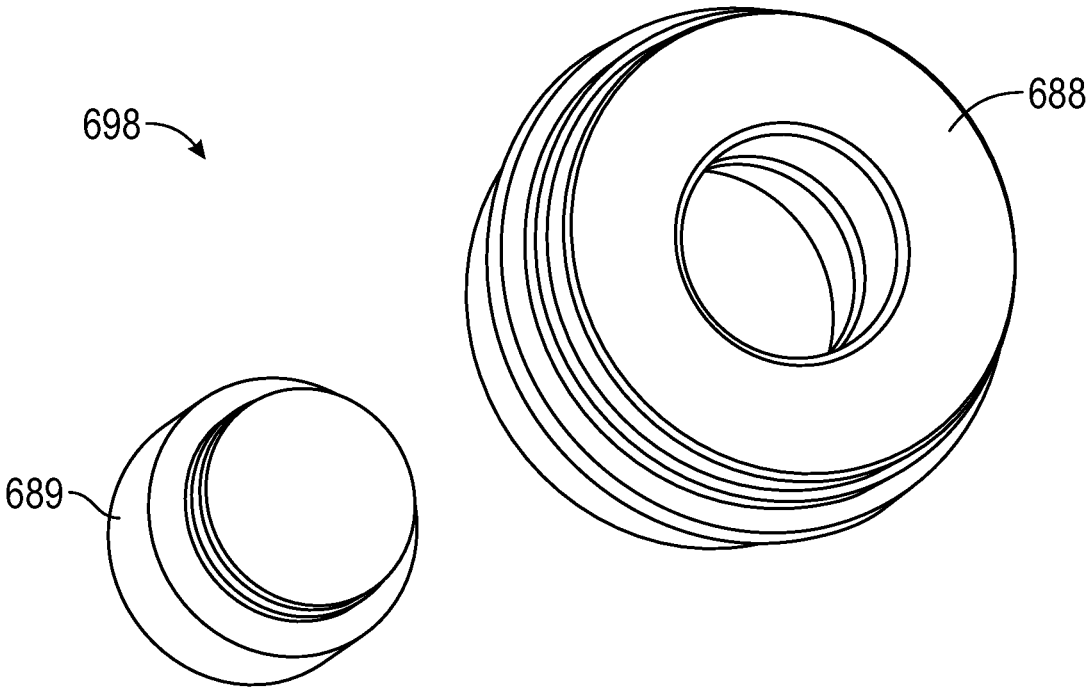
FIG. 6B shows a component view of the stopper assembly of FIG. 5A, according to embodiments of the disclosure.

Referring now to FIGS. 6A and 6B, an isometric component breakout view of a plugging device and an isometric breakout view of a baffle-stopper assembly, in accordance with embodiments disclosed herein, are shown.

As would be apparent while the valves described herein may be stationary as part of a tubular (204, 504, etc.), a plugging device 614 may be disposed within the tubular and run downhole therethrough. A valve (e.g., 202, 302, 402*a*, etc.) of the present disclosure may have the plugging device 614 moved into engagement therewith, and thus forming a valve-plugging device assembly.

The plugging device 614 may be run, positioned, and operated as described herein and in other embodiments (such as in system 500, and so forth), and as otherwise understood to one of skill in the art. The plugging device 614 may be comparable or identical in aspects, function, operation, components, etc. as that of other embodiments disclosed herein. Similarities may not be discussed for the sake of brevity. Just the same, the plugging device 614 is not limited to any particular type of configuration, and thus may be any type of plugging device suitable for engaging and moving a valve.

FIGS. 6A and 6B together show the plugging device 614 may have a main plug body or mandrel 650. Although not limited to any particular shape, the main plug body 650 may be a generally cylindrical shape with a plug bore 653. The bore 653 may extend through the entire plug body 650 from a distal end 654 to a proximate end 655. An inner diameter (see Db, FIG. 7A) of the bore 653 may be any size as desired, and may be suitable for the flow of fluids therethrough.

Although a plug inner surface may be generally smooth, an outer plug surface 652 may be configured with one or more undulations or ring grooves 651. The grooves 651 may have a relationship with the movement of an index sleeve 557 that may be disposed around the body 650, and may be engaged with the outer surface 652. As such, the index sleeve 657 may be configured to generally accommodate whatever the shape of the body 650 may be.

Even though the index sleeve 657 may be movingly engaged with the body 650, there may be some amount of resistance that mitigates against completely free movement. This may be from, for example, a coefficient of friction between the surfaces of the grooves 651 and the index sleeve 657.

While not meant to be limited, embodiments herein pertain to how in operation the index sleeve 657 may only move in one direction, such as from the distal end 654 toward the proximate end 655. For example, when the index sleeve 657 comes into contact with a shoulder surface of a frac sleeve, the surface may be resilient enough to bump increment the index sleeve 657. This may be a 'count', 'cycle', 'increment' 'index', etc. of the index sleeve 657. The plugging device 514 may then resume passage all the way through the sleeve, and proceed to a next valve sleeve, where the count sequence may repeat, albeit with the sleeve 657 indexed a single count.

The plugging device 614 may be configured to count any desired amount of frac sleeves (of respective valves) simply by extending the length of the device 614 and/or adding a desired amount or configuration of grooves 651. In embodiments there may be a range of an at least one valve to at least 1,000 valves. The range may be about 10 valves to about 100 valves. It is worth noting that the plugging device 614 may be configured to count a first frac valve, but pass through a next or second valve without counting it (i.e., without indexing [moving] the sleeve 657).

The proximate end 655 may have an upper sleeve 668 engaged therewith. The engagement with the proximate end 655 may be threadingly. The upper sleeve 668 may also have an upper cup or support fin 669 engaged therewith. The engagement between the upper sleeve 668 and the upper support fin 669 may be threadingly, bonded, glued, etc. In assembly of the plugging device 614, the upper support fin 669 may first be coupled with the upper sleeve 668, and then the upper sleeve (with fin 669) may be engaged with the body 650, such as threadingly.

The body 650 or the upper sleeve 668 may have an upper seat 670. The seat 670 may be configured for a removable plug to fit thereagainst; however, instead of a typical ball, the seat 670 may be configured to engage a stopper assembly 698.

The presence of the stopper assembly provides the ability for fluid pressure to flow the plugging device 614 downhole toward clusters of valves. The stopper assembly 698 may include a stopper 689 and a baffle 688. The baffle 688 may engage the seat 670, and the stopper 689 may reside in the baffle 688 (or a portion thereof).

Either or both of the stopper 689 and the baffle 688 may be made of a dissolvable material, which, while not limited, may be metallic. When the assembly 698 is seated, flow through the bore 653 may be obstructed; however, when the stopper 689 unseats, fluid may flow through the bore 653.

Figure 7A:
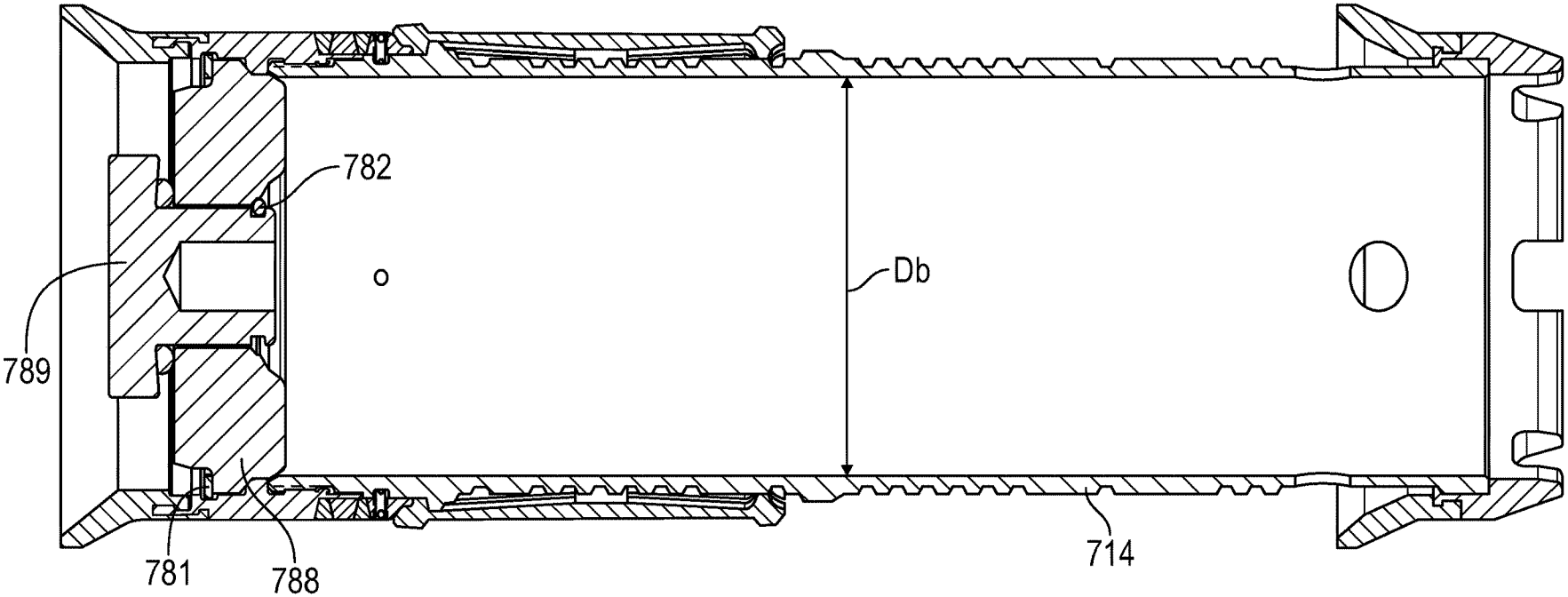
FIG. 7A shows a partial longitudinal side view of a plugging device configured with a baffle, according to embodiments of the disclosure.
Figure 7B:
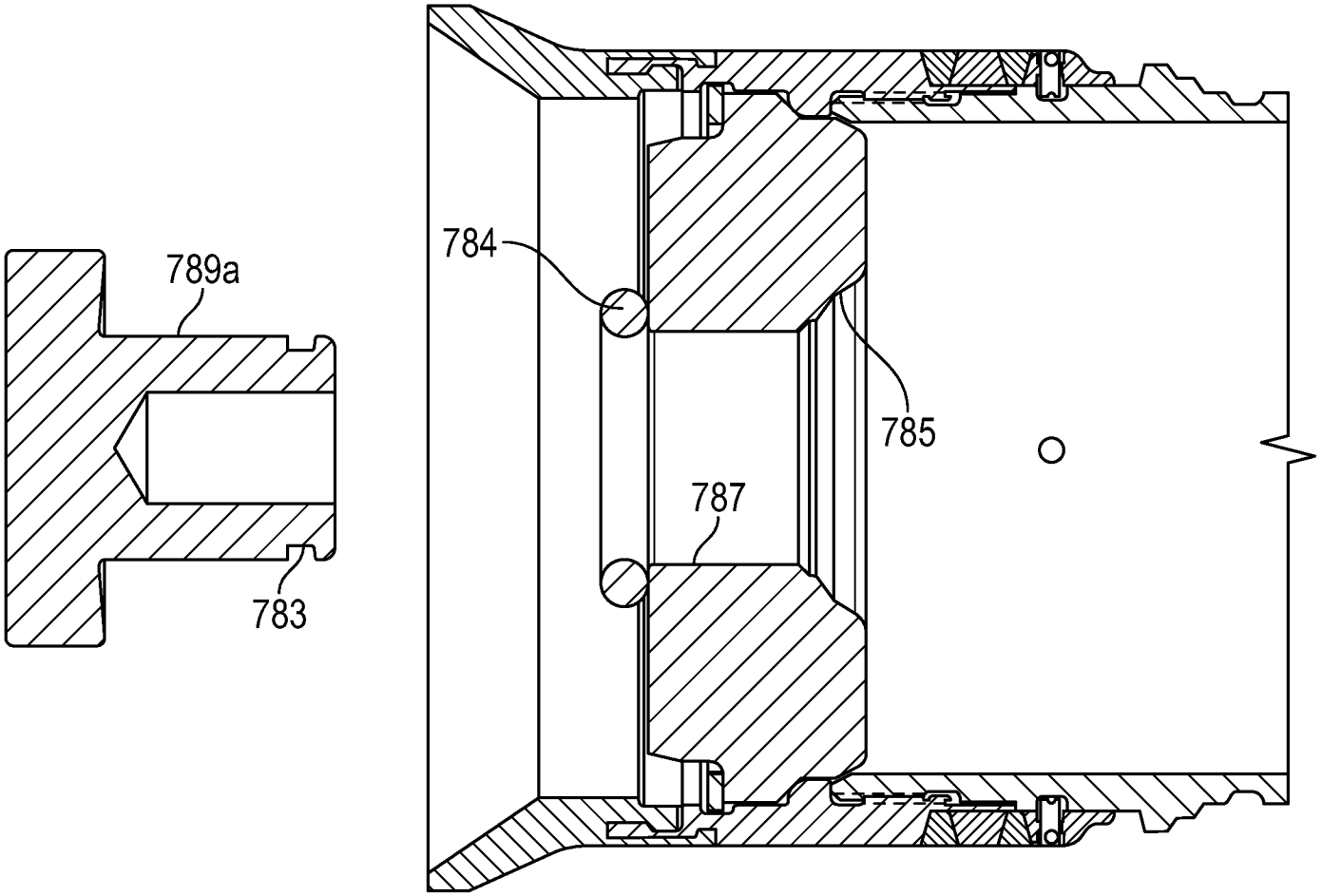
FIG. 7B shows a partial longitudinal side view of the plugging device of FIG. 7A with a stopper removed from the baffle, according to embodiments of the disclosure.

Referring now to FIGS. 7A-7B, a longitudinal side cross-sectional view of a plugging device, and a side cross-sectional zoom in view of an end of the plugging device, respectively, in accordance with embodiments disclosed herein, are shown.

FIGS. 7A and 7B together show a partial longitudinal side view of a plugging device configured with a baffle, and with a stopper removed from the baffle, respectively, in accordance with embodiments disclosed herein.

In this example, a certain pressure differential, which may be predetermined, may be applied from above the device 714 in order to effectively "arm" a stopper 789. That is, pressure may be applied against the stopper 789 in a sufficient manner, whereby a compressible member (such as an o-ring or comparable) 784 may compress to a degree whereby a key 782 may fall away from the stopper 789. The key 782 may initially reside within a key slot 783 formed in an elongated portion 789*a* of the stopper 789. The key 782 may be, for example, a ball bearing.

While engaged with a sidewall (or chamfer, bevel, etc.) 785 of a passageway 787 of a baffle 788, the stopper 789 may be prevented from disengaging the baffle 788, and thus obstruct flow (F). But sufficient pressure may urge the stopper 789 just enough against the compressible member 784, whereby the key 782 may fall away, and the stopper 789 may now be freely movable out of the passageway 787 from any downhole pressure (i.e., pressure from below the device 714 may allow the stopper 789 to be pumped out of the device 714 with flow F from the stage below).

The baffle 788 may be installed in the device 714, and secured in place with a retainer 781, such as a snap ring. The compressible member 784 may be installed between the baffle 788 and the stopper 789, as shown here, to provide axial resistance which maintains the key 782 in place. Once the plugging device 714 is landed in the frac sleeve (e.g., 202, 502, etc.), applied pressure above the device 714 may compress the compressible member 784, which may result in slight downward movement of the stopper 789, which may thereby allows the key 782 to fall therefrom (such as due to gravity). Once the key 782 is removed, the stopper 789 may be pumped out of the device 714 with minimal pressure from below, which may provide bilateral flowability through the device 714.

Other embodiments may include a stopper and baffle configuration that does not require arming; instead, the stopper may be simply pumped out of the baffle once a required differential pressure is reached from below the plugging device.

Figure 8A:
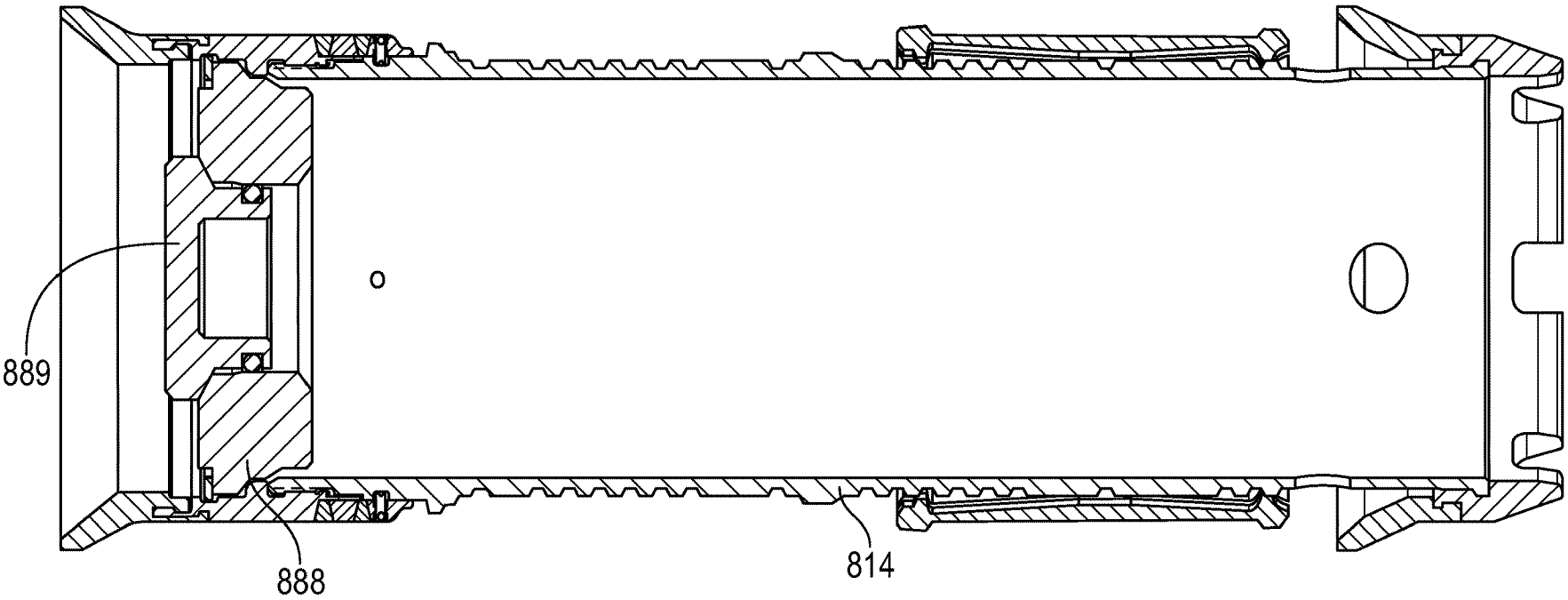
FIG. 8A shows a partial longitudinal side view of a plugging device configured with a baffle, according to embodiments of the disclosure.
Figure 8B:
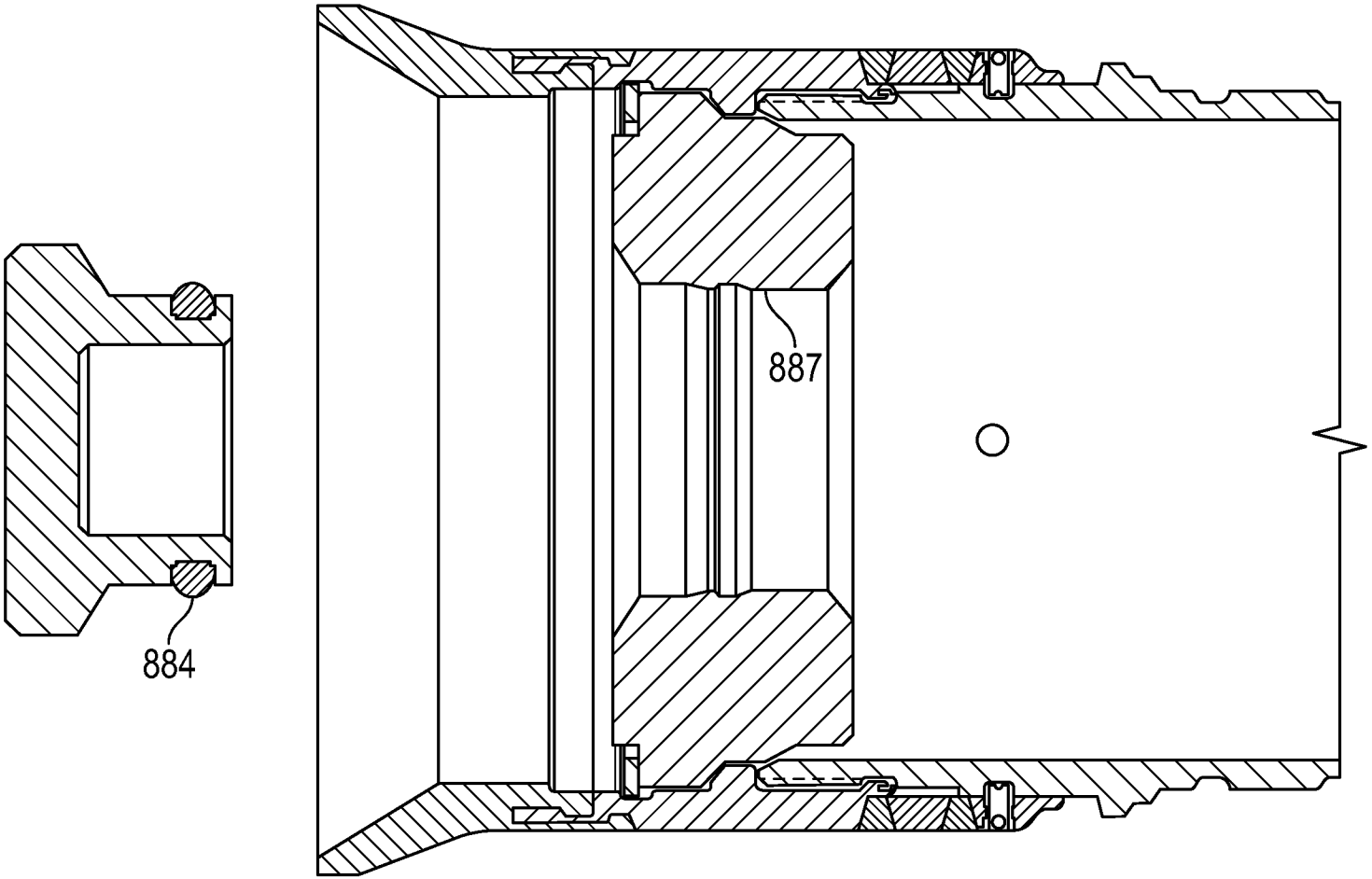
FIG. 8B shows a partial longitudinal side view of the plugging device of FIG. 8A with a stopper removed from the baffle, according to embodiments of the disclosure.

Referring now to FIGS. 8A and 8B together, a longitudinal side cross-sectional view of a plugging device configured with a baffle, and a close-up longitudinal side view the plugging device with a stopper removed from the baffle, respectively, in accordance with embodiments disclosed herein.

In this example (which may be comparable to FIGS. 6A and 6B), a plugging device 814 may have a plugging assembly that includes a stopper 889 and a baffle 888. The stopper 889 may be retained within the baffle 888 via a friction member 884 (such as an o-ring or other comparable component). The stopper 889 may be held in place when the plugging device 814 is pumped in the hole and during fracturing. The stopper 889 may be seated against a bevel in the baffle 888 to allow high pressure to be applied from thereabove.

Nothing more is required to remove the stopper 889 other than adequate pressure from below the plugging device 814 to overcome friction associated with the friction member 984 being in contact with a sidewall of the passageway 887.

Figure 9A:
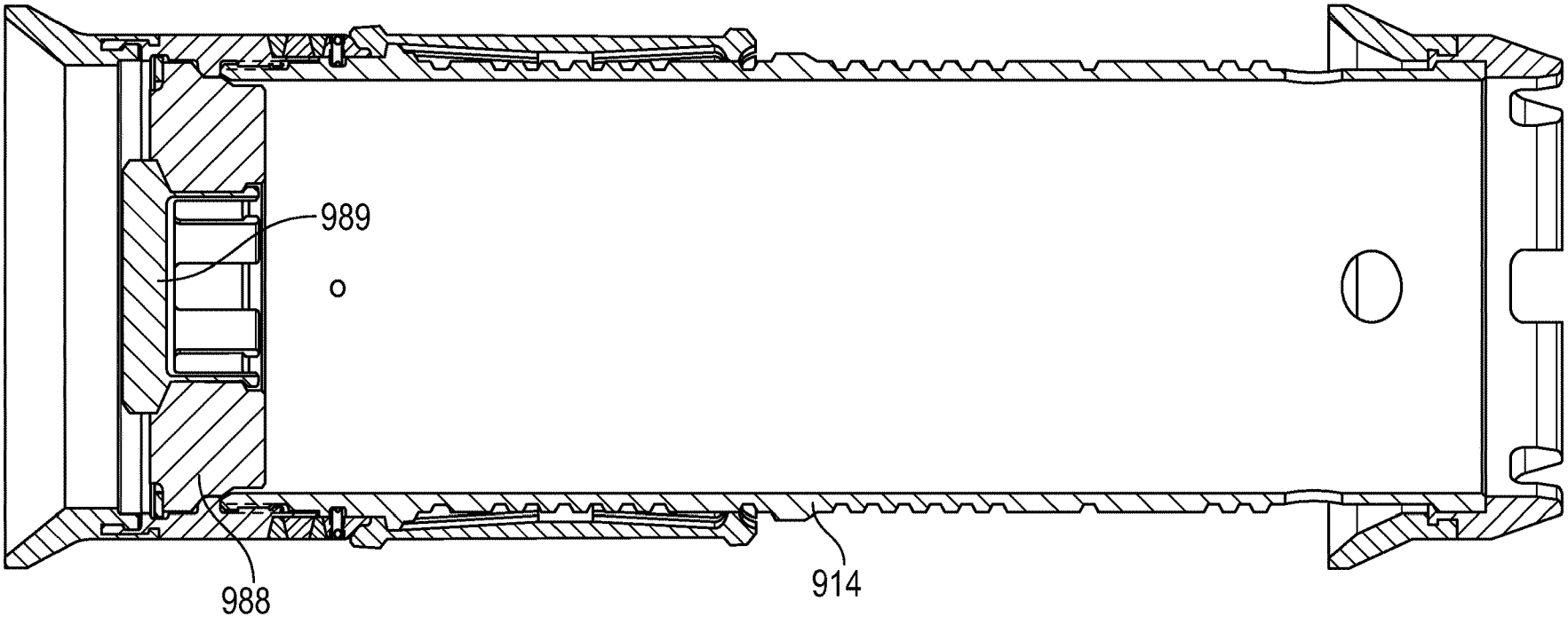
FIG. 9A shows a partial longitudinal side view of a plugging device configured with a baffle, according to embodiments of the disclosure.
Figure 9B:
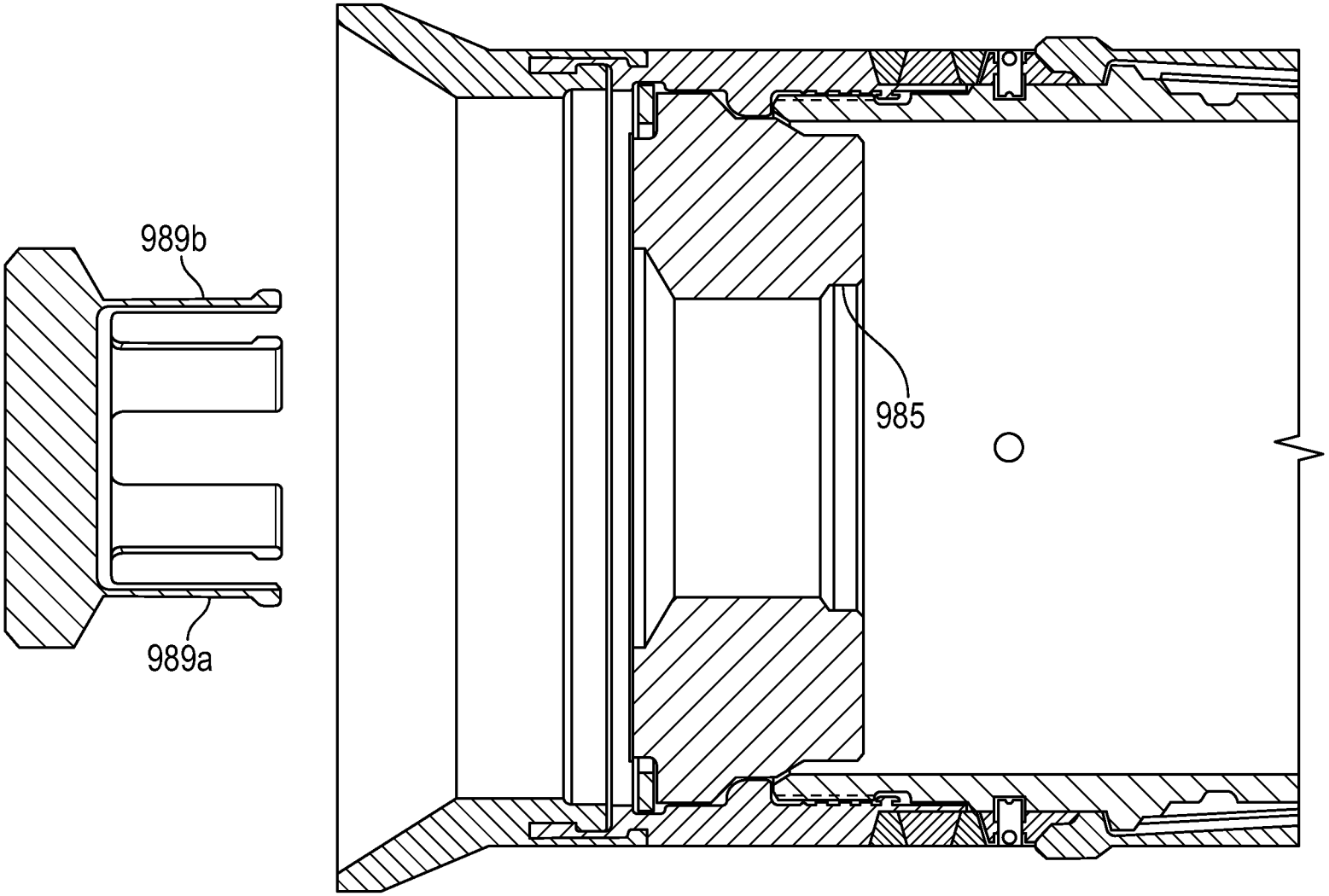
FIG. 9B shows a partial longitudinal side view of the plugging device of FIG. 9A with a stopper removed from the baffle, according to embodiments of the disclosure.

Referring now to FIGS. 9A and 9B together, a partial longitudinal side view of a plugging device configured with a baffle, and with a stopper removed from the baffle, respectively, in accordance with embodiments disclosed herein.

In this example, a stopper 989 may be retained within a baffle 988 via a friction member 989*a*, which may be a collet finger or the like that is coupled with or part of the stopper 989. In particular, a collet finger end 989*b* may engage against a receptacle shoulder 985. The stopper 989 may be held in place when the plugging device 914 is pumped in the hole and during fracturing. The stopper 989 may be seated against a bevel in the baffle 988 to allow high pressure to be applied from thereabove.

Nothing more is required to remove the stopper 989 other than adequate pressure from below the plugging device 914 to overcome friction associated with the friction member end 989*b* being in contact with the shoulder 985.

Any embodiment of the disclosure may utilize slight (or greater) flowback from below the plugging device to push the plug free of the dart. This is facilitated by flowing back the well for a short period of time to push the plug out of the dart.

If required after pumping the remaining proppant below the plugging, a ball may be pumped to the plugging device and seal against a ball seat in the device that may otherwise be exposed whenever the stopper has been pumped out.

One or more components of any device of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react when in contact with a reaction-inducing stimulant (fluid) in the wellbore, but remain functional for about 3 to about 48 hours after exposure to a reaction-inducing stimulant.

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components may be made of non-dissolvable materials (e.g., materials suitable for and are known to withstand downhole environments [including extreme pressure, temperature, fluid properties, etc.] for an extended period of time (predetermined or otherwise) as may be desired). Components may be 3D-printed or made with other forms of additive manufacturing.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A plugging device for multistage fracturing a subterranean formation, the plugging device comprising:

a plug body having a distal end, a proximate end, and an outer surface;

a plurality of grooves formed on the outer surface;

an index sleeve movingly disposed around the outer surface, and engaged with an at least one of the plurality of grooves;

an upper sleeve engaged with the proximate end;

a support fin engaged with the upper sleeve;

a bore through the plugging device; and a stopper assembly disposed within the plugging device, wherein the stopper assembly is installed in the plugging device in manner that allows pressure integrity from above the plugging device, and further configured to allow the bore of the plugging device to open with an at least minimal pressure from therebelow in order to provide a flow path through the plugging device in both directions, and wherein an at least one component of the stopper assembly is made of dissolvable metal.

2. The plugging device of claim 1, wherein the stopper assembly comprises a stopper and a compressible member.

3. The plugging device of claim 2, a seat is formed on a surface in the bore, and wherein the stopper assembly engages the seat.

4. The plugging device of claim 3, wherein the compressible member is disposed in contact with each of the stopper and the seat.

5. The plugging device of claim 1, wherein each component of the stopper assembly is made of dissolvable metal.

6. The plugging device of claim 1, wherein an at least one component of the stopper assembly is made of a dissolvable metal, and wherein during initial operation the plugging device is pumped into a wellbore in a manner whereby the index sleeve increments from the at least one of the plurality of grooves to an adjacent groove after the index sleeve comes into contact with a shoulder surface of a frac sleeve disposed in the wellbore.

7. A plugging device for multistage fracturing a subterranean formation, the plugging device comprising:

a plug body having a distal end, a proximate end, and an outer surface;

a plurality of grooves formed on the outer surface;

an index sleeve movingly disposed around the outer surface, and engaged with an at least one of the plurality of grooves;

an upper sleeve engaged with the proximate end;

a support fin engaged with the upper sleeve;

a bore running through the plugging device;

a seat disposed on an inner surface in the bore; and a stopper assembly engaged with the seat;

wherein the stopper assembly is installed in the plugging device in manner that allows pressure integrity from above the plugging device when the plugging device is seated in a wellbore tubular, and further configured to allow the bore of the plugging device to open with an at least minimal pressure from therebelow in order to provide a flow path through the plugging device in both directions while the plugging device remains seated, wherein the index sleeve is incrementally movable along the plurality of the grooves as the plugging device passes through a tubular sleeve, and wherein an at least one component of the stopper assembly is made of dissolvable metal.

8. The plugging device of claim 7, wherein the stopper assembly comprises a stopper and a compressible member.

9. The plugging device of claim 8, wherein the compressible member is disposed in contact with each of the stopper and the seat.

10. The plugging device of claim 7, wherein the stopper assembly comprises a ball, and wherein the ball is made of dissolvable metal.

11. The plugging device of claim 7, wherein an at least one component of the stopper assembly is made of a magnesium-based metallic material.

12. The plugging device of claim 7, wherein the stopper assembly is disposed within at least one of the support fin, the upper sleeve, and combinations thereof.

13. A plugging device for multistage fracturing a subterranean formation, the plugging device comprising:

a plug body having a distal end, a proximate end, and an outer surface;

a seat formed in the inner bore on the inner surface;

a plurality of grooves formed on the outer surface;

an collet style index sleeve movingly disposed around the outer surface, and engaged with an at least one of the plurality of grooves;

an upper sleeve engaged with the proximate end;

a support fin engaged with the upper sleeve;

a bore running through the plugging device;

a seat disposed on a surface in the bore; and a stopper assembly engaged with the seat;

wherein the stopper assembly is installed in the plugging device in manner that allows pressure integrity from above the plugging device when seated in a wellbore tubular, and further configured to allow the inner bore of the plugging device to open with an at least minimal pressure from therebelow in order to provide a flow path through the plugging device in both directions, wherein an at least one component of the stopper assembly is made of dissolvable metal, and wherein the index sleeve is configured to incrementally movable along the plurality of the grooves as the plugging device passes through a tubular sleeve.

14. The plugging device of claim 13, wherein each component of the stopper assembly is made of dissolvable metal.

15. The plugging device of claim 14, wherein the downhole tool is run into the wellbore tubular via pumpdown.

* * * * *